US008508555B2

(12) United States Patent
Sawa

(10) Patent No.: US 8,508,555 B2
(45) Date of Patent: Aug. 13, 2013

(54) PLASMA DISPLAY DEVICE

(75) Inventor: Kazuki Sawa, Osaka (JP)

(73) Assignee: Panasonic Corporation, Osaka (JP)

( * ) Notice: Subject to any disclaimer, the term of this patent is extended or adjusted under 35 U.S.C. 154(b) by 641 days.

(21) Appl. No.: 12/743,408

(22) PCT Filed: Jan. 30, 2009

(86) PCT No.: PCT/JP2009/000350

§ 371 (c)(1),
(2), (4) Date: May 18, 2010

(87) PCT Pub. No.: WO2009/096186

PCT Pub. Date: Aug. 6, 2009

(65) Prior Publication Data

US 2010/0265276 A1 Oct. 21, 2010

(30) Foreign Application Priority Data

Jan. 31, 2008 (JP) ..... 2008-020464

(51) Int. Cl.
*G09G 5/10* (2006.01)

(52) U.S. Cl.
USPC ..... 345/690; 345/691; 345/692

(58) Field of Classification Search
USPC ..... 345/36, 45, 77, 60–69, 84, 94, 204–213, 345/690–692; 363/15, 89; 382/238, 141; 307/43
See application file for complete search history.

(56) References Cited

U.S. PATENT DOCUMENTS 6,987,510 B2 * 1/2006 Iwami et al. ..... 345/211
8,179,341 B2 * 5/2012 Yamada ..... 345/60
2002/0118312 A1 8/2002 Ishizuka et al.
2004/0004610 A1 * 1/2004 Iwami et al. ..... 345/211
2004/0061380 A1 * 4/2004 Hann et al. ..... 307/43
2004/0062058 A1 * 4/2004 Hann et al. ..... 363/15
2006/0055634 A1 3/2006 Han
2009/0174634 A1 * 7/2009 Kohno ..... 345/84
2010/0128017 A1 * 5/2010 Yamada ..... 345/212
2010/0277461 A1 * 11/2010 Ruckmongathan ..... 345/213

FOREIGN PATENT DOCUMENTS

JP 10-187093 7/1998
JP 10187093 A 7/1998
JP 11-282398 10/1999
JP 2000-066638 A 3/2000
JP 2002-149109 A 5/2002
JP 2002-258793 A 9/2002
JP 2003-066893 A 3/2003

(Continued)

OTHER PUBLICATIONS

International Search Report for International Application No. PCT/JP2009/000350, Apr. 21, 2009, Panasonic Corp.

*Primary Examiner* — Prabodh M Dharia
(74) *Attorney, Agent, or Firm* — RatnerPrestia

(57) ABSTRACT

A plasma display device includes an image signal processing circuit having a sequential addressing processing circuit, an alternate addressing processing circuit and an image data selection circuit. The sequential addressing processing circuit includes a sequential addressing array unit for converting an image signal into image data arranged in the order corresponding to a sequential address operation. The alternate addressing processing circuit includes an alternate addressing array unit for converting an image signal into image data arranged in the order corresponding to an alternate address operation. The image data selecting circuit selecting between the sequential and alternate addressing operations based on predicted power consumption.

6 Claims, 10 Drawing Sheets

(56) References Cited

FOREIGN PATENT DOCUMENTS

| | | | |
|---|---|---|---|
| JP | 2003066893 | A | 3/2003 |
| JP | 2003-140597 | A | 5/2003 |
| JP | 2003140597 | A | 5/2003 |
| JP | 2003-173161 | A | 6/2003 |
| JP | 2003173161 | A | 6/2003 |
| JP | 2006-071774 | A | 3/2006 |
| JP | 2006-079063 | A | 3/2006 |
| JP | 200679063 | A | 3/2006 |
| JP | 2006071774 | A | 3/2006 |
| JP | 2007-333839 | A | 12/2007 |
| JP | 2007333839 | A | 12/2007 |

* cited by examiner

FIG. 6A

| | Dj-2 | Dj-1 | Dj | Dj+1 | Dj+2 |
|---|---|---|---|---|---|
| SCi-2 | 3 | 12 | 3 | 12 | 3 |
| SCi-1 | 12 | 3 | 12 | 3 | 12 |
| SCi | 3 | 12 | 3 | 12 | 3 |
| SCi+1 | 12 | 3 | 12 | 3 | 12 |
| SCi+2 | 3 | 12 | 3 | 12 | 3 |

FIG. 6B

| | Dj-2 | Dj-1 | Dj | Dj+1 | Dj+2 |
|---|---|---|---|---|---|
| SCi-2 | 1 | 0 | 1 | 0 | 1 |
| SCi-1 | 0 | 1 | 0 | 1 | 0 |
| SCi | 1 | 0 | 1 | 0 | 1 |
| SCi+1 | 0 | 1 | 0 | 1 | 0 |
| SCi+2 | 1 | 0 | 1 | 0 | 1 |

FIG. 6C

| | Dj-2 | Dj-1 | Dj | Dj+1 | Dj+2 |
|---|---|---|---|---|---|
| SCi-2 | 1 | 0 | 1 | 0 | 1 |
| SCi-1 | 0 | 1 | 0 | 1 | 0 |
| SCi | 1 | 0 | 1 | 0 | 1 |
| SCi+1 | 0 | 1 | 0 | 1 | 0 |
| SCi+2 | 1 | 0 | 1 | 0 | 1 |

FIG. 6D

| | Dj-2 | Dj-1 | Dj | Dj+1 | Dj+2 |
|---|---|---|---|---|---|
| SCi-2 | 0 | 1 | 0 | 1 | 0 |
| SCi-1 | 1 | 0 | 1 | 0 | 1 |
| SCi | 0 | 1 | 0 | 1 | 0 |
| SCi+1 | 1 | 0 | 1 | 0 | 1 |
| SCi+2 | 0 | 1 | 0 | 1 | 0 |

FIG. 6E

| | Dj-2 | Dj-1 | Dj | Dj+1 | Dj+2 |
|---|---|---|---|---|---|
| SCi-2 | 0 | 1 | 0 | 1 | 0 |
| SCi-1 | 1 | 0 | 1 | 0 | 1 |
| SCi | 0 | 1 | 0 | 1 | 0 |
| SCi+1 | 1 | 0 | 1 | 0 | 1 |
| SCi+2 | 0 | 1 | 0 | 1 | 0 |

FIG. 10A

| | Dj-2 | Dj-1 | Dj | Dj+1 | Dj+2 |
|---|---|---|---|---|---|
| SCi-2 | 3 | 15 | 3 | 15 | 3 |
| SCi-1 | 15 | 3 | 15 | 3 | 15 |
| SCi | 3 | 11 | 3 | 11 | 3 |
| SCi+1 | 11 | 3 | 11 | 3 | 11 |
| SCi+2 | 3 | 11 | 3 | 11 | 3 |

FIG. 10B

| | Dj-2 | Dj-1 | Dj | Dj+1 | Dj+2 |
|---|---|---|---|---|---|
| SCi-2 | 1 | 1 | 1 | 1 | 1 |
| SCi-1 | 1 | 1 | 1 | 1 | 1 |
| SCi | 1 | 1 | 1 | 1 | 1 |
| SCi+1 | 1 | 1 | 1 | 1 | 1 |
| SCi+2 | 1 | 1 | 1 | 1 | 1 |

FIG. 10C

| | Dj-2 | Dj-1 | Dj | Dj+1 | Dj+2 |
|---|---|---|---|---|---|
| SCi-2 | 1 | 1 | 1 | 1 | 1 |
| SCi-1 | 1 | 1 | 1 | 1 | 1 |
| SCi | 1 | 1 | 1 | 1 | 1 |
| SCi+1 | 1 | 1 | 1 | 1 | 1 |
| SCi+2 | 1 | 1 | 1 | 1 | 1 |

FIG. 10D

| | Dj-2 | Dj-1 | Dj | Dj+1 | Dj+2 |
|---|---|---|---|---|---|
| SCi-2 | 0 | 1 | 0 | 1 | 0 |
| SCi-1 | 1 | 0 | 1 | 0 | 1 |
| SCi | 0 | 0 | 0 | 0 | 0 |
| SCi+1 | 0 | 0 | 0 | 0 | 0 |
| SCi+2 | 0 | 0 | 0 | 0 | 0 |

FIG. 10E

| | Dj-2 | Dj-1 | Dj | Dj+1 | Dj+2 |
|---|---|---|---|---|---|
| SCi-2 | 0 | 1 | 0 | 1 | 0 |
| SCi-1 | 1 | 0 | 1 | 0 | 1 |
| SCi | 0 | 1 | 0 | 1 | 0 |
| SCi+1 | 1 | 0 | 1 | 0 | 1 |
| SCi+2 | 0 | 1 | 0 | 1 | 0 |

FIG. 11

| Number of subfields in which address operation is stopped | Total electric power consumption | Determination |
|---|---|---|
| Sequential addressing < alternate addressing | — | Sequential addressing |
| Sequential addressing > alternate addressing | — | Alternate addressing |
| Sequential addressing = alternate addressing | Sequential addressing ≤ alternate addressing | Sequential addressing |
| Sequential addressing = alternate addressing | sequential addressing > alternate addressing | Alternate addressing |

PLASMA DISPLAY DEVICE

THIS APPLICATION IS A U.S. NATIONAL PHASE APPLICATION OF PCT INTERNATIONAL APPLICATION PCT/JP2009/000350.

TECHNICAL FIELD

The present invention relates to a plasma display device using an AC type plasma display panel.

BACKGROUND ART

A plasma display panel (hereinafter abbreviated as "panel") is one of well-known image display devices having a large number of pixels arranged two-dimensionally. The panel includes a large number of discharge cells having scan electrodes, sustain electrodes, and data electrodes. In each discharge cell, a gas discharge is generated to excite and illuminate phosphors, thereby achieving color display.

A plasma display device with such a panel displays image mainly uses a subfield method. This method divides one field into a plurality of subfields having predetermined luminance weights, and each discharge cell is controlled to emit or not to emit light in each subfield so as to display image.

A plasma display device includes a scan electrode drive circuit for driving scan electrodes, a sustain electrode drive circuit for driving sustain electrodes, and a data electrode drive circuit for driving data electrodes. These driving circuits apply the electrodes with necessary drive voltage waveforms. The data electrode drive circuit is generally composed of dedicated ICs because it needs to apply address pulses required for an address operation individually to the large number of data electrodes based on an image signal. When the panel is viewed from the perspective of the data electrode drive circuit, each data electrode is a capacitive load with stray capacitance between itself and adjacent data electrodes and between itself and the corresponding pair of scan electrode and sustain electrode. Therefore, in order to apply the data electrodes with drive voltage waveforms, the capacitance has to be charged and discharged, thereby consuming electric power. The data electrode drive circuit, however, requires minimizing its electric power consumption in order to be integrated into an IC.

The electric power consumption of the data electrode drive circuit increases as the current to charge and discharge the capacitance of the data electrodes increases. The charge-discharge current largely depends on the image signal representing the image to be displayed. For example, when address pulses are not applied to any of the data electrodes, the charge-discharge current becomes "0", and hence, the data electrode drive circuit requires minimum electric power. When address pulses are applied to all data electrodes, on the other hand, the charge-discharge current also becomes "0", and hence, the data electrode drive circuit requires low electric power. When address pulses are applied in a random order to the data electrodes, however, the charge-discharge current is large. In particular, when address pulses are applied alternately to adjacent data electrodes, the data electrode drive circuit consumes large electric power. This is because the data electrode drive circuit needs to charge and discharge the capacitance between adjacent data electrodes and the capacitance between a data electrode and the corresponding pair of scan electrode and sustain electrode.

A proposed method for reducing the electric power consumption of the data electrode drive circuit is as follows (see, for example, Patent Document 1). The electric power consumption of the data electrode drive circuit is predicted based on an image signal, and the address operation in subfields is inhibited in ascending order of luminance weight.

Another proposed method for reducing the electric power consumption of the data electrode drive circuit is as follows (see, for example, Patent Document 2). Instead of completely inhibiting the address operation in subfields, the frequency of an address operation is reduced. This method can maintain image display quality although the effect of reducing the electric power is smaller than the method of Patent Document 1.

Another proposed method for reducing the electric power consumption of the data electrode drive circuit is as follows (see, for example, Patent Document 3). The charge-discharge current is reduced by changing the order in which to apply address pulses to the data electrodes. This method can maintain image display quality although the effect of reducing the electric power largely depends on the image to be displayed.

In recent years, along with the increasing definition and screen size of the panels, the data electrode drive circuit requires an increasing amount of electric power. As described above, however, in order to integrate the data electrode drive circuit into an IC, it is impossible to increase its electric power without limitation. It is also impermissible to greatly reduce image display quality because high image quality is essential. When some methods for processing image signals are switched in order to reduce the electric power consumption of the data electrode drive circuit, it is impermissible to cause a decrease in image display quality such as flickering due to the switching.

Patent Document 1: Japanese Patent Unexamined Publication No. 2000-66638

Patent Document 2: Japanese Patent Unexamined Publication No. 2002-149109

Patent Document 3: Japanese Patent Unexamined Publication No. H11-282398

SUMMARY OF THE INVENTION

The plasma display device of the present invention includes a panel, a scan electrode drive circuit, a sustain electrode drive circuit, a data electrode drive circuit, and an image signal processing circuit. The panel includes a plurality of discharge cells, each of the discharge cell having a data electrode and a display electrode pair consisting of a scan electrode and a sustain electrode. The scan electrode drive circuit, the sustain electrode drive circuit, and the data electrode drive circuit drive the scan electrode, the sustain electrode, and the data electrode, respectively, in one field composed of a plurality of subfields each having an address period where a sequential address operation or an alternate address operation is performed, and a sustain period where the discharge cells that have performed the address operation emit light. The sequential address operation is performed by applying a scan pulse sequentially to the scan electrodes and applying an address pulse to the data electrodes. The alternate address operation is performed by applying a scan pulse alternately to the scan electrodes and applying an address pulse to the data electrodes. The image signal processing circuit converts a received image signal into image data to be supplied to the data electrode drive circuit.

The image signal processing circuit includes an image data conversion circuit, a sequential addressing processing circuit, an alternate addressing processing circuit, and an image data selection circuit. The image data conversion circuit converts the image signal into image data indicating emission or non-emission of light of the discharge cells in each subfield. The sequential addressing processing circuit converts the output of the image data conversion circuit into image data corresponding to the sequential address operation. The alternate addressing processing circuit converts the output of the image data conversion circuit into image data corresponding to the alternate address operation. The image data selection circuit selects between the output of the sequential addressing processing circuit and the output of the alternate addressing processing circuit.

The sequential addressing processing circuit includes a sequential addressing array unit, a first unconverted power prediction unit, a first data power conversion unit, a first addressing stop unit, and a first converted power prediction unit. The sequential addressing array unit arranges the output of the image data conversion circuit in the order corresponding to the sequential address operation. The first unconverted power prediction unit predicts the electric power consumption of the data electrode drive circuit based on the output of the sequential addressing array unit. The first data power conversion unit converts the output of the sequential addressing array unit corresponding to the specific subfields into image data which allows the data electrode drive circuit to have low electric power consumption. The first addressing stop unit converts the output of the first data power conversion unit so that the address operation in the specific subfields is stopped to make the electric power consumption of the data electrode drive circuit not more than a predetermined power threshold value. The first converted power prediction unit predicts the electric power consumption of the data electrode drive circuit based on the output of the first addressing stop unit.

The alternate addressing processing circuit includes an alternate addressing array unit, a second unconverted power prediction unit, a second data power conversion unit, a second addressing stop unit, and a second converted power prediction unit. The alternate addressing array unit arranges the output of the image data conversion circuit in the order corresponding to the alternate address operation. The second unconverted power prediction unit predicts the electric power consumption of the data electrode drive circuit based on the output of the alternate addressing array unit. The second data power conversion unit converts the output of the alternate addressing array unit corresponding to specific subfields into image data which allows the data electrode drive circuit to have low electric power consumption. The second addressing stop unit converts the output of the second data power conversion unit so that the address operation in the specific subfields is stopped to make the electric power consumption of the data electrode drive circuit not more than the predetermined power threshold value. The second converted power prediction unit predicts the electric power consumption of the data electrode drive circuit based on the output of the second addressing stop unit.

The image signal processing circuit equalizes the number of the specific subfields for which the first data power conversion unit converts the image data converted from the received image signal into image data which allows the data electrode drive circuit to have low electric power consumption, and the number of the specific subfields for which the second data power conversion unit converts the image data converted from the received image signal into image data which allows the data electrode drive circuit to have low electric power consumption.

With this structure, the plasma display device produces no flickering or other similar problems, causes no great decrease in image display quality, and controls the electric power consumption to be not more than a predetermined threshold value.

In the plasma display device of the present invention, the number of the specific subfields for which the first and second data power conversion units convert the image data converted from the received image signal into the image data which allows the data electrode drive circuit to have low electric power consumption is preferably determined based on the larger one between the electric power consumption predicted by the first unconverted power prediction unit and the electric power consumption predicted by the second unconverted power prediction unit.

BRIEF DESCRIPTION OF THE DRAWINGS

FIG. 6A shows a checkerboard pattern of gradation values corresponding to scan electrodes and data electrodes.

FIG. 6B shows another checkerboard pattern of gradation values corresponding to the scan electrodes and data electrodes.

FIG. 6C shows another checkerboard pattern of gradation values corresponding to the scan electrodes and data electrodes.

FIG. 6D shows another checkerboard pattern of gradation values corresponding to the scan electrodes and data electrodes.

FIG. 6E shows another checkerboard pattern of gradation values corresponding to the scan electrodes and data electrodes.

FIG. 10A is a diagram for explaining the operation of a data power conversion unit of the plasma display device.

FIG. 10B is another diagram for explaining the operation of the data power conversion unit of the plasma display device.

FIG. 10C is another diagram for explaining the operation of the data power conversion unit of the plasma display device.

FIG. 10D is another diagram for explaining the operation of the data power conversion unit of the plasma display device.

FIG. 10E is another diagram for explaining the operation of the data power conversion unit of the plasma display device.

FIG. 11 shows the operation of an image data determination unit of the plasma display device.

REFERENCE MARKS IN THE DRAWINGS

Figure 1:
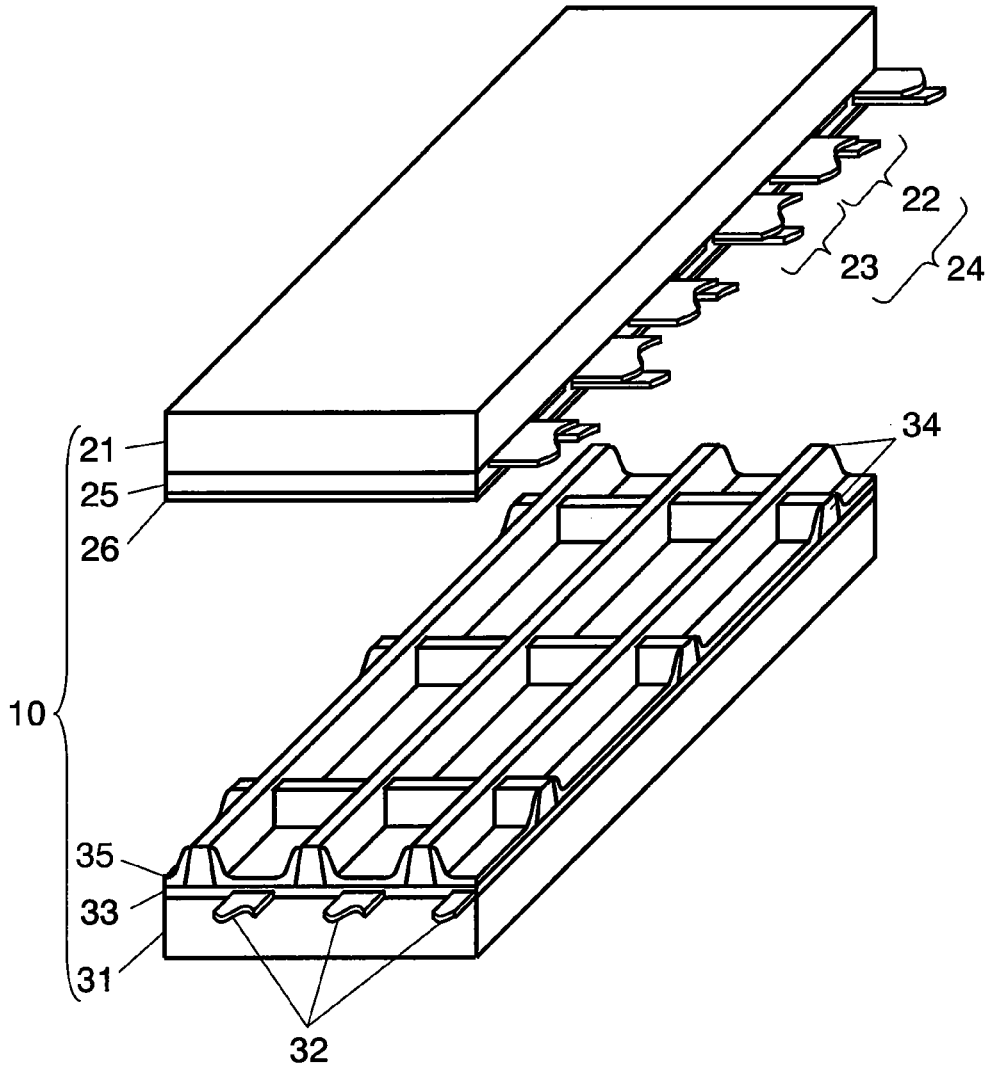
FIG. 1 is an exploded perspective view of a panel of a plasma display device according to an embodiment of the present invention.

10 panel
21 front substrate

22 scan electrodes
23 sustain electrodes
24 display electrode pair
25 dielectric layer
26 protective layer
31 rear substrate
32 data electrode
33 dielectric layer
34 barrier rib
35 phosphor layer
41 image signal processing circuit
42 data electrode drive circuit
43 scan electrode drive circuit
44 sustain electrode drive circuit
45 timing generating circuit
50 image data conversion circuit
51 sequential addressing processing circuit
52 alternate addressing processing circuit
55 image data selection circuit
56 image data determination unit
57 image data selection unit
59 largest value selection circuit
61 sequential addressing array unit
62 (first) unconverted power prediction unit
63 (first) data power conversion unit
64 (first) addressing stop unit
65 (first) converted power prediction unit
71 alternate addressing array unit
72 (second) unconverted power prediction unit
73 (second) data power conversion unit
74 (second) addressing stop unit
75 (second) converted power prediction unit
100 plasma display device
Vs sustain pulse voltage
Cd interelectrode capacitance
Cs interelectrode capacitance

DETAILED DESCRIPTION OF PREFERRED EMBODIMENT

A plasma display device according to an embodiment of the present invention will be described as follows with reference to drawings.

Embodiment

FIG. 1 is an exploded perspective view of panel 10 of a plasma display device according to the embodiment of the present invention. Panel 10 includes front substrate 21 and rear substrate 31, which are made of glass. Front substrate 21 is provided thereon with display electrode pairs 24 consisting of scan electrodes 22 and sustain electrodes 23, which are coated with dielectric layer 25, which is further coated with protective layer 26. Rear substrate 31 is provided thereon with data electrodes 32, dielectric layer 33, and mesh barrier ribs 34. Rear substrate 31 further includes phosphor layers 35 that emit light in each color of red, green, and blue formed on the side surfaces of barrier ribs 34 and on dielectric layer 33.

Front substrate 21 and rear substrate 31 are oppositely disposed so that display electrode pairs 24 and data electrodes 32 intersect with each other with a small discharge space therebetween. Front and rear substrates 21 and 31 are sealed at their peripheries with a sealing member such as a glass frit so as to form a discharge space. The discharge space is filled with a discharge gas, which is, for example, a mixture gas of neon and xenon. The discharge space is partitioned into a plurality of sections by barrier ribs 34. The discharge space includes discharge cells in the areas where display electrode pairs 24 and data electrodes 32 intersect with each other. The discharge cells are discharged to emit light so that images can be displayed. Thus, panel 10 includes a plurality of discharge cells having data electrodes 32 and display electrode pairs 24 consisting of scan electrodes 22 and sustain electrodes 23.

The structure of panel 10 is not limited to the one described above. For example, the barrier ribs may be formed in a stripe pattern.

Figure 2:
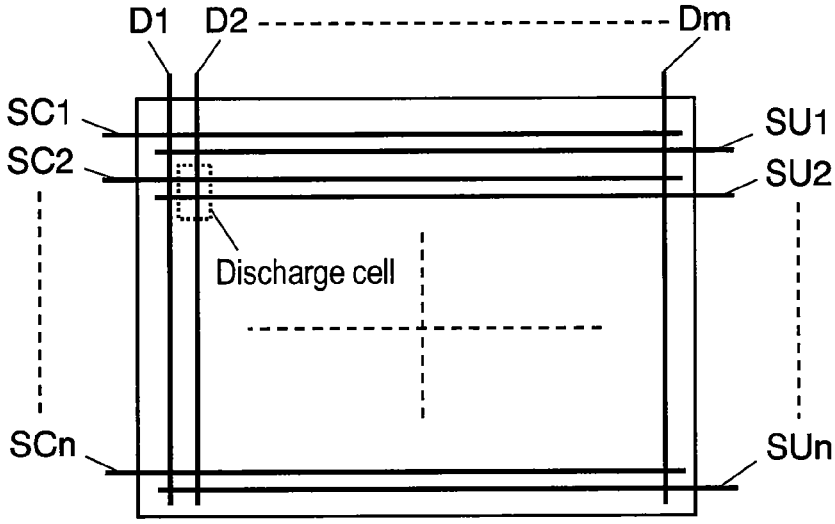
FIG. 2 shows an electrode array of the panel.

FIG. 2 shows an electrode array of panel 10. Panel 10 includes n scan electrodes SC1 to SCn (corresponding to scan electrodes 22 of FIG. 1) and n sustain electrodes SU1 to SUn (corresponding to sustain electrodes 23 of FIG. 1) extending in the row direction, that is, in the line direction. Panel 10 further includes m data electrodes D1 to Dm (corresponding to data electrodes 32 of FIG. 1) extending in the column direction. Each discharge cell is formed in the area where one pair of scan electrode SCi (i=1 to n) and sustain electrode SUi intersects with one data electrode Dj (j=1 to m). As a result, the discharge space includes m×n discharge cells, which correspond to the pixels used to display an image.

Figure 3:
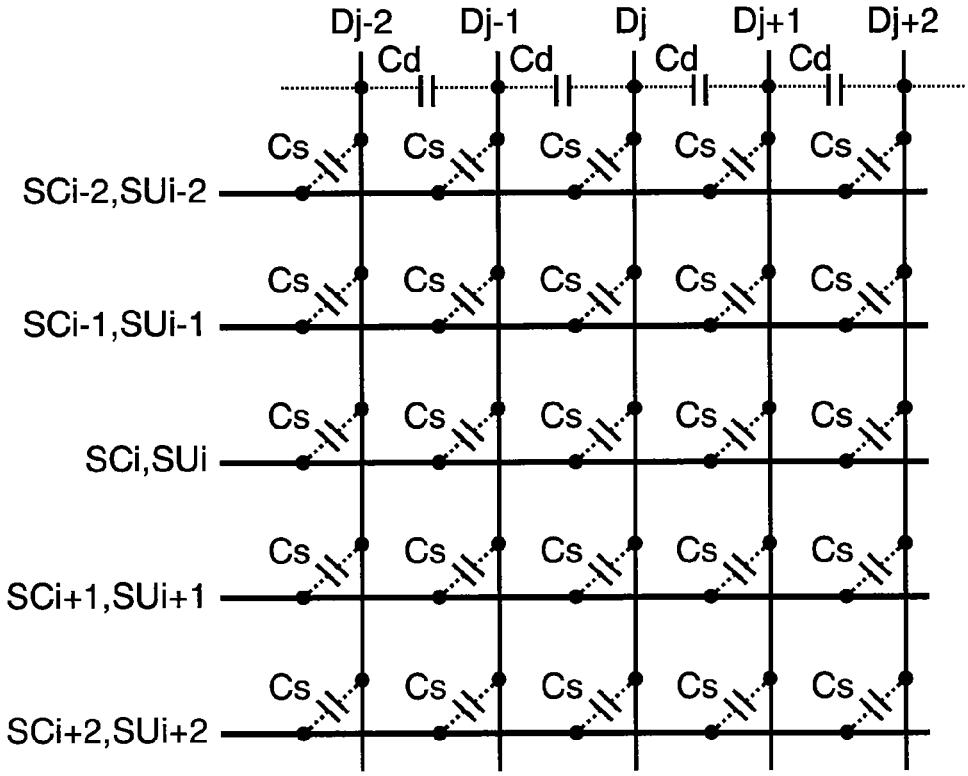
FIG. 3 is a schematic diagram showing interelectrode capacitances of the panel.

The electrodes thus disposed have interelectrode capacitances. FIG. 3 is a schematic diagram showing interelectrode capacitances of panel 10, which are related to data electrodes. Between display electrode pairs and data electrodes, there exist interelectrode capacitances Cs. Between adjacent data electrodes, there exist interelectrode capacitances Cd.

More specifically, FIG. 3 shows interelectrode capacitances Cs at the intersections of five data electrodes Dj−2 to Dj+2 and five pairs of scan electrodes SCi−2 to SCi+2 and sustain electrodes SUi−2 to SUi+2, and also shows interelectrode capacitances Cd between five data electrodes Dj−2 to Dj+2. Each display electrode pair consisting of scan electrode SCi and sustain electrode SUi is shown in a thick horizontal line, and the interelectrode capacitance between the display electrode pair and data electrode Dj is shown as Cs.

The following is a description of a method for driving the panel. In the embodiment, gradation according to an image signal is displayed by a so-called subfield method. In this method, one field is divided into a plurality of subfields, and in each subfield, each discharge cell is controlled to emit or not to emit light so as to achieve gray scale display.

In the embodiment, one field is divided into ten subfields having luminance weights of "1", "2", "3", "6", "11", "18", "30", "44", "60", and "81", respectively. For ease of explanation, however, one field in the following description is divided into four subfields (the first SF, the second SF, the third SF, and the fourth SF) having luminance weights of "1", "2", "4", and "8", respectively.

Figure 4:
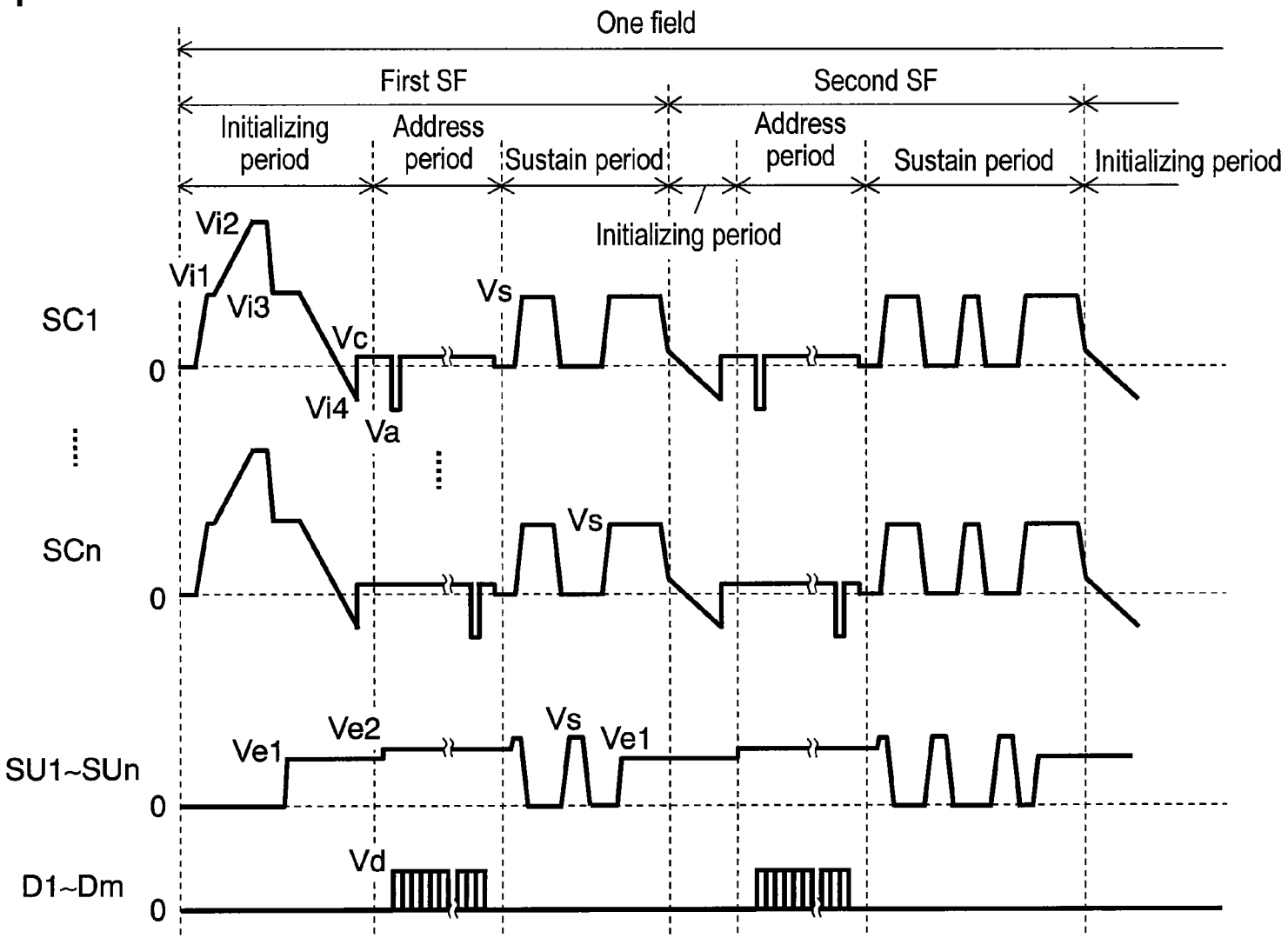
FIG. 4 shows drive voltage waveforms applied to the electrodes of the panel.

Each subfield includes an initializing period, an address period, and a sustain period. FIG. 4 shows drive voltage waveforms applied to the electrodes of panel 10. Although FIG. 4 shows drive voltage waveforms in only two subfields, the other subfields also have nearly the same voltage waveforms.

In the initializing period of a subfield, data electrodes D1 to Dm and sustain electrodes SU1 to SUn are applied with 0V, and scan electrodes SC1 to SCn are subjected to a ramp voltage gradually rising from voltage Vi1 to voltage Vi2. Later, sustain electrodes SU1 to SUn are applied with voltage Ve1, and scan electrodes SC1 to SCn are subjected to a ramp voltage gradually falling from voltage V13 to voltage V14. As a result, a weak initialization discharge is generated in all discharge cells so as to form wall charges necessary for the subsequent address operation on the electrodes. The operation in an initializing period may alternatively be to subject scan electrodes SC1 to SCn to the gradually falling ramp voltage as shown in the initializing period of the second SF of FIG. 4.

In the address period, sustain electrodes SU1 to SUn are applied with voltage Ve2, scan electrodes SC1 to SCn are applied with voltage Vc, and data electrodes D1 to Dm are applied with 0V.

Scan electrode SCi in the i-th line, which performs an address operation, is applied with scan pulse voltage Va, and data electrode Dk (k=1 to m) corresponding to the discharge cell to emit light is applied with address pulse voltage Vd. As a result, the discharge cell in the i-th line applied with scan pulse voltage Va and address pulse voltage Vd at the same time generates an address discharge and performs an address operation to accumulate wall charges on scan electrode SCi and sustain electrode SUi.

The above-described address operation is repeated in the discharge cells in all lines so as to generate an address discharge selectively in the discharge cells that are supposed to emit light, thereby forming wall charges. The order in which to apply scan pulses to the scan electrodes is arbitrary. In the address operation performed in the embodiment, scan pulses can be applied to the scan electrodes either sequentially or alternately. In the former address operation, scan pulses are applied in the order of scan electrodes SC1, SC2, SC3, . . . and SCn (hereinafter abbreviated as "sequential address operation"). In the latter address operation, scan pulses are applied in the order of scan electrodes SC1, SC3, SC5, . . . SCn−1, SC2, SC4, SC6, . . . and SCn (hereinafter abbreviated as "alternate address operation"). Thus, scan electrodes 22, sustain electrodes 23, and data electrodes 32 are driven in one field composed of a plurality of subfields having an address period and a sustain period. In the address period, either the sequential address operation or the alternate address operation is performed. In the sequential address operation, scan pulses are sequentially applied to scan electrodes 22, and address pulses are applied to data electrodes 32. In the alternate address operation, scan pulses are applied alternately to scan electrodes 22, and address pulses are applied to data electrodes 32. In the sustain period, the discharge cells that have performed an address operation emit light.

Data electrodes D1 to Dm are driven by a data electrode drive circuit, which will be described later. From the perspective of the data electrode drive circuit, each data electrode Dk is a capacitive load. Therefore, this capacitance has to be charged and discharged every time the voltage applied to the data electrodes is switched from ground potential 0V to address pulse voltage Vd or from address pulse voltage Vd to ground potential 0V in the address period. As the number of times of charging and discharging is larger, the electric power consumption of the data electrode drive circuit is larger. In order to reduce the electric power consumption of the data electrode drive circuit, in the embodiment, the order in which to apply scan pulses to the scan electrodes is switched. More specifically, the order in which to apply scan pulses to the scan electrodes is switched so as to reduce the number of times of charging and discharging, which will be described in detail later.

In the subsequent sustain period, sustain electrodes SU1 to SUn are applied with 0V, and scan electrodes SC1 to SCn are applied with sustain pulse voltage Vs. As a result, the discharge cells that have performed an address discharge generate a sustain discharge and emit light.

Then, scan electrodes SC1 to SCn are applied with 0V, and sustain electrodes SU1 to SUn are applied with sustain pulse voltage Vs. As a result, the discharge cells that have generated a sustain discharge again generate a sustain discharge and emit light. Since the luminance weight of the first SF is "1", scan electrodes SC1 to SCn and sustain electrodes SU1 to SUn are applied with a sustain pulse, for example, one time each. Thus, the discharge cells that have performed an address operation emit light. Then, scan electrodes SC1 to SCn are applied with sustain pulse voltage Vs, and sustain electrodes SU1 to SUn are applied with voltage Ve1 so as to erase the wall charges, thereby completing the sustain period of the first SF.

In the subsequent subfield, the same operation as in the above-described subfield is performed to make the discharge cells emit light so that images can be displayed. Note that in the sustain period of the second SF, scan electrodes SC1 to SCn and sustain electrodes SU1 to SUn are applied with a sustain pulse, for example, twice each. In the sustain period of the third SF, scan electrodes SC1 to SCn and sustain electrodes SU1 to SUn are applied with a sustain pulse, for example, four times each. In the sustain period of the fourth SF, scan electrodes SC1 to SCn and sustain electrodes SU1 to SUn are applied with a sustain pulse, for example, eight times each. Thus, the discharge cells emit light at a luminance corresponding to the luminance weight of each subfield.

Figure 5:
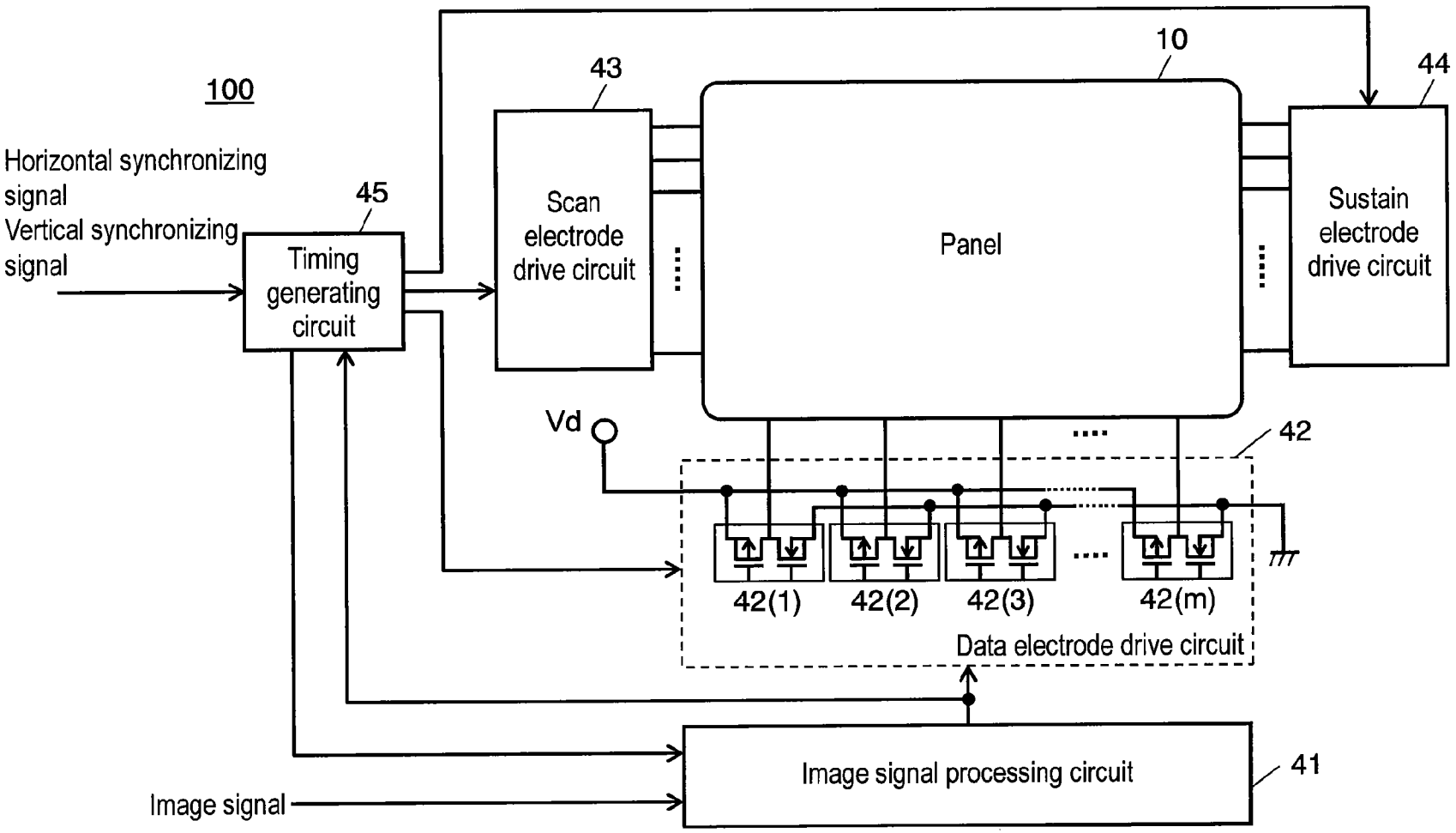
FIG. 5 is a circuit block diagram of the plasma display device according to the embodiment of the present invention.

FIG. 5 is a circuit block diagram of plasma display device 100 according to the embodiment of the present invention. Plasma display device 100 includes panel 10, image signal processing circuit 41, data electrode drive circuit 42, scan electrode drive circuit 43, sustain electrode drive circuit 44, timing generating circuit 45, and a power supply circuit (not shown) for supplying electric power to the circuit blocks. Scan electrode drive circuit 43, sustain electrode drive circuit 44, and data electrode drive circuit 42 drive scan electrodes 22, sustain electrodes 23, and data electrodes 32, respectively, of FIG. 1.

Image signal processing circuit 41 converts a received image signal into image data, which is a digital signal indicating emission and non-emission of light in each subfield by "1" and "0", respectively. Image signal processing circuit 41 then converts the image data so that the electric power of data electrode drive circuit 42 is not more than a predetermined power threshold value, and transmits the image data to data electrode drive circuit 42.

Data electrode drive circuit 42 includes m switch circuits 42 (1) to 42 (*m*) for applying either address pulse voltage Vd or 0V to m data electrodes D1 to Dm of FIG. 2. Data electrode drive circuit 42 converts the image data received from image signal processing circuit 41 into address pulses which correspond to data electrodes D1 to Dm, and applies them to data electrodes D1 to Dm.

Data electrode drive circuit 42 is composed of a plurality of dedicated ICs (hereinafter, "data drivers") because it requires driving data electrodes D1 to Dm separately from each other based on the image data. In the embodiment, the number m of the data electrodes is 4000, data electrode drive circuit 42 is composed of 16 data drivers IC1 to IC16, and the number of outputs of each data driver is 256. In the present invention, however, the number of the data electrodes, and the number of outputs of each data driver are not limited.

The driving circuit for driving the large number of data electrodes is integrated into an IC and is made compact, thereby reducing the mounting area and the cost. However, the data drivers, which have a limited allowable power loss, are required to be used in such a manner that their electric power consumption is within this limitation.

Timing generating circuit 45 generates various timing signals for controlling the operations of the circuits, based on horizontal and vertical synchronizing signals, and supplies the timing signals to the circuits. Scan electrode drive circuit 43 drives scan electrodes SC1 to SCn based on the timing signals. Sustain electrode drive circuit 44 drives sustain electrodes SU1 to SUn based on the timing signals.

The following is a detailed description of the relation between the image signal and the electric power consumption of data electrode drive circuit 42. The electric power consumption of data electrode drive circuit 42 greatly differs depending on the image displayed. This will be explained by taking a typical image pattern as an example. The electric power consumption in the embodiment is the electric power consumption during an address operation.

FIGS. 6A, 6B, 6C, 6D, and 6E show checkerboard patterns of gradation values corresponding to pixels representing 25 (=5×5) discharge cells.

In the checkerboard pattern of FIG. 6A, gradation values "3" and "12" are alternately arranged both in the horizontal and vertical directions.

FIG. 6B shows the presence or absence of an address pulse in the first SF generated from the image data corresponding to the pattern of FIG. 6A. FIGS. 6C, 6D, and 6E show the presence or absence of an address pulse in the second, third, and fourth SFs, respectively. In FIGS. 6B to 6E, "0s" and "1s" indicate the absence and the presence, respectively, of an address pulse.

Figure 7:
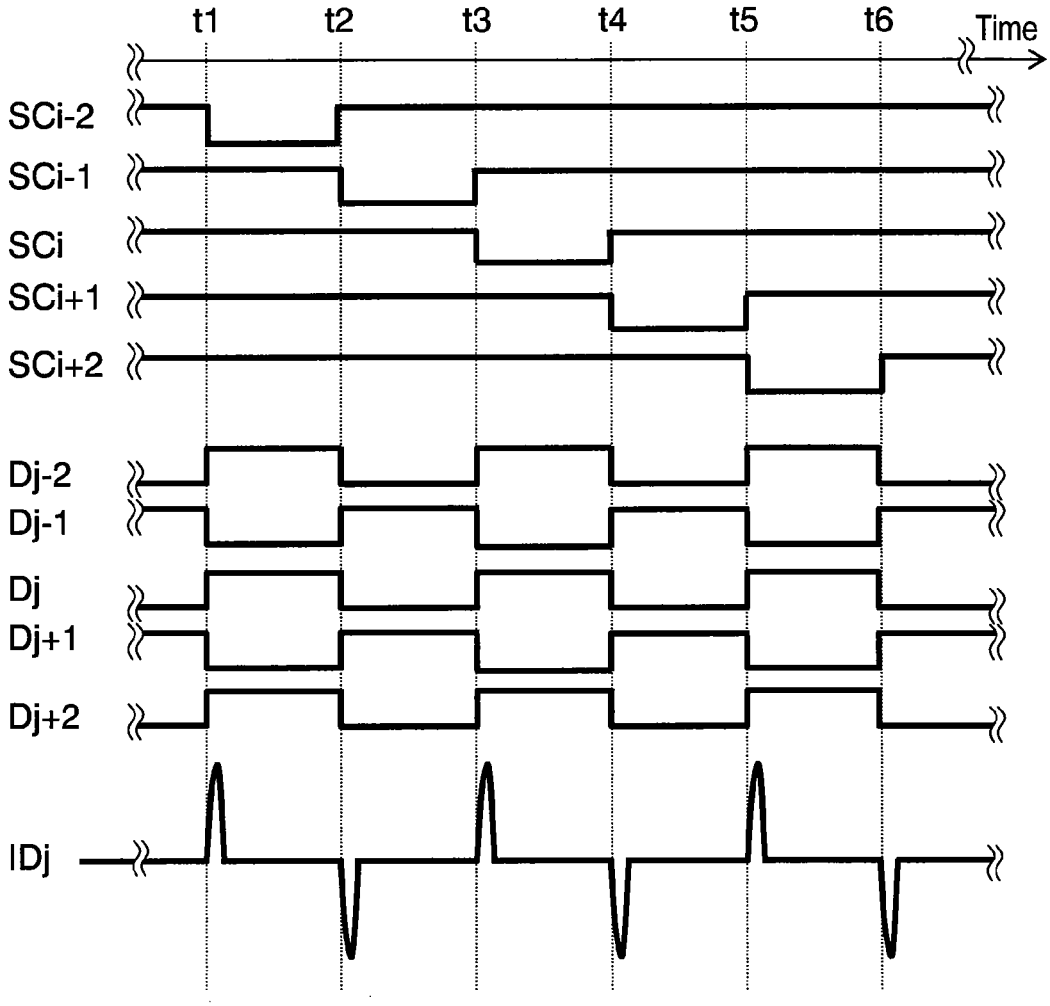
FIG. 7 is a diagram for estimating the electric power consumption of a data electrode drive circuit.

FIG. 7 is a diagram for estimating the electric power consumption of data electrode drive circuit 42. FIG. 7 shows drive voltage waveforms and a current waveform in the address period of the first SF when an address operation is performed by applying scan pulses to scan electrodes SC1, SC2, SC3, . . . SCn in this order, that is, a sequential address operation is performed.

More specifically, FIG. 7 shows scan pulses applied to scan electrodes SCi−2 to SCi+2, address pulses applied to data electrodes Dj−2 to Dj+2, and current waveform IDj flowing in data electrode Dj by the charging and discharging of the interelectrode capacitance. The horizontal axis represents time and the vertical axis represents waveforms from time t1 to t6.

In the period from time t1 to t2, scan electrode SCi−2 is applied with a scan pulse, and data electrodes Dj−2, Dj, and Dj+2 are applied with an address pulse so as to generate an address discharge. In this case, data electrodes Dj−1 and Dj+1 are not applied with an address pulse so as not to generate an address discharge.

In the period from time t2 to t3, scan electrode SCi−1 is applied with a scan pulse and data electrodes Dj−1 and Dj+1 are applied with an address pulse so as to generate an address discharge. Data electrodes Dj−2, Dj, and Dj+2 are not applied with an address pulse so as not to generate an address discharge.

The application of address pulses of FIG. 7 is continued in the same manner to make the discharge cells having "1" in FIG. 6B emit light in the first SF.

When attention is focused on current IDj flowing in data electrode Dj, a current exists which charges and discharges interelectrode capacitances Cs between data electrode Dj and pairs of scan electrodes SC1 to SCn and sustain electrodes SU1 to SUn, and another current exists which charges and discharges interelectrode capacitances Cd against the address pulses applied in opposite phase to data electrodes Dj−1 and Dj+1 adjacent to data electrode Dj. Therefore, when the gradation values are arranged in a checkerboard pattern, data electrode drive circuit 42 has extremely large electric power consumption.

Figure 8:
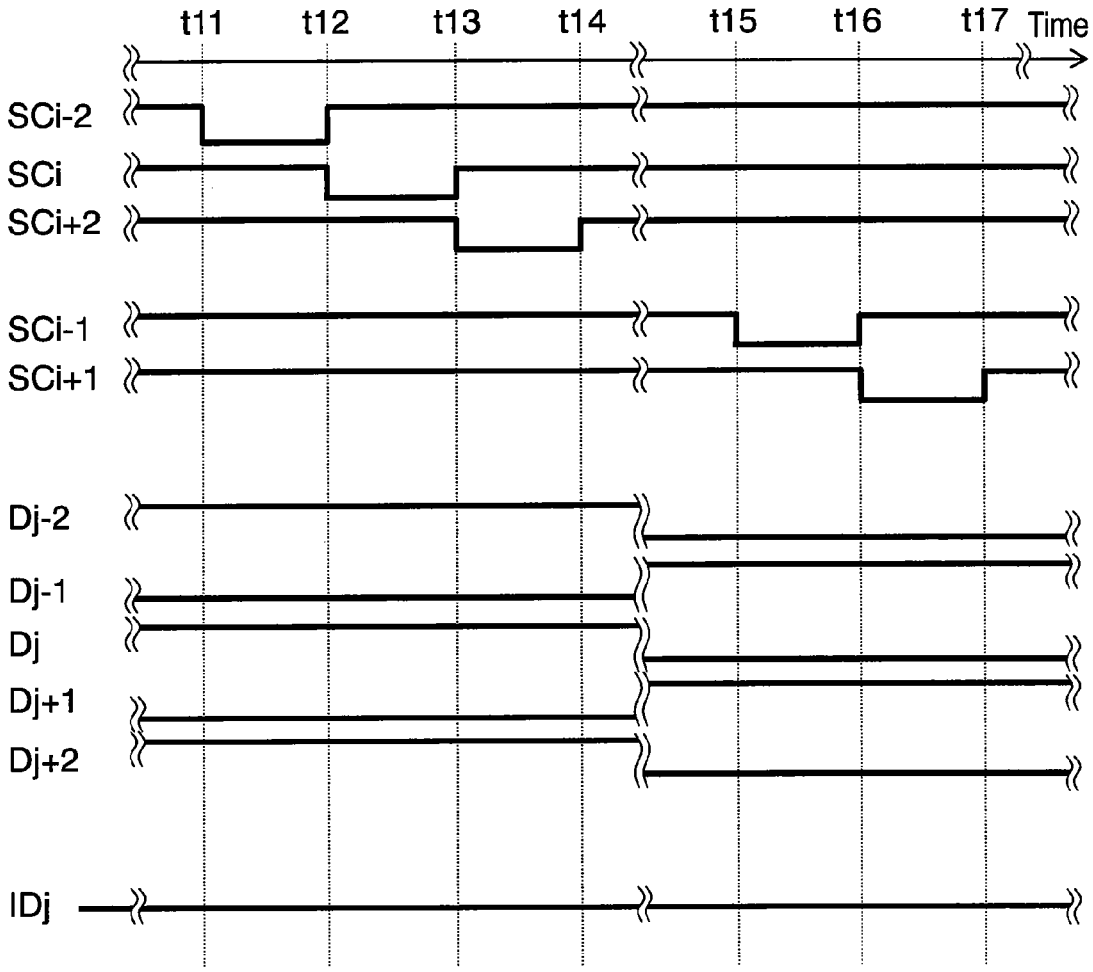
FIG. 8 is another diagram for estimating the electric power consumption of the data electrode drive circuit.

FIG. 8 is another diagram for estimating the electric power consumption of data electrode drive circuit 42 when displaying the same checkerboard pattern as in FIG. 7. FIG. 8 shows drive voltage waveforms and the waveform of a current to charge and discharge an interelectrode capacitance in the address period of the first SF when an address operation is performed by applying scan pulses to scan electrodes SC1, SC3, SC5, . . . SCn−1, SC2, SC4, SC6, . . . SCn in this order, that is, an alternate address operation is performed. The horizontal axis represents time and the vertical axis represents waveforms from time t11 to t17.

In the period from time t11 to t12, scan electrode SCi−2 is applied with a scan pulse, and data electrodes Dj−2, Dj, and Dj+2 are applied with an address pulse so as to generate an address discharge. In this case, data electrodes Dj−1 and Dj+1 are not applied with an address pulse so as not to generate an address discharge.

In the period from time t12 to t13, scan electrode SCi is applied with a scan pulse, and data electrodes Dj−2, Dj, and Dj+2 continue to be applied with an address pulse so as to generate an address discharge. In the subsequent period, data electrodes Dj−2, Dj, and Dj+2 continue to be applied with an address pulse, data electrodes Dj−1 and Dj+1 continue not to be applied with an address pulse. As a result, data electrode Dj is not applied with a charge-discharge current so as to make current IDj=0, thereby reducing the electric power consumption.

Thus, the electric power consumption of data electrode drive circuit 42 greatly differs depending on the order in which to apply scan pulses to the scan electrodes even when the same pattern is displayed.

Figure 9:
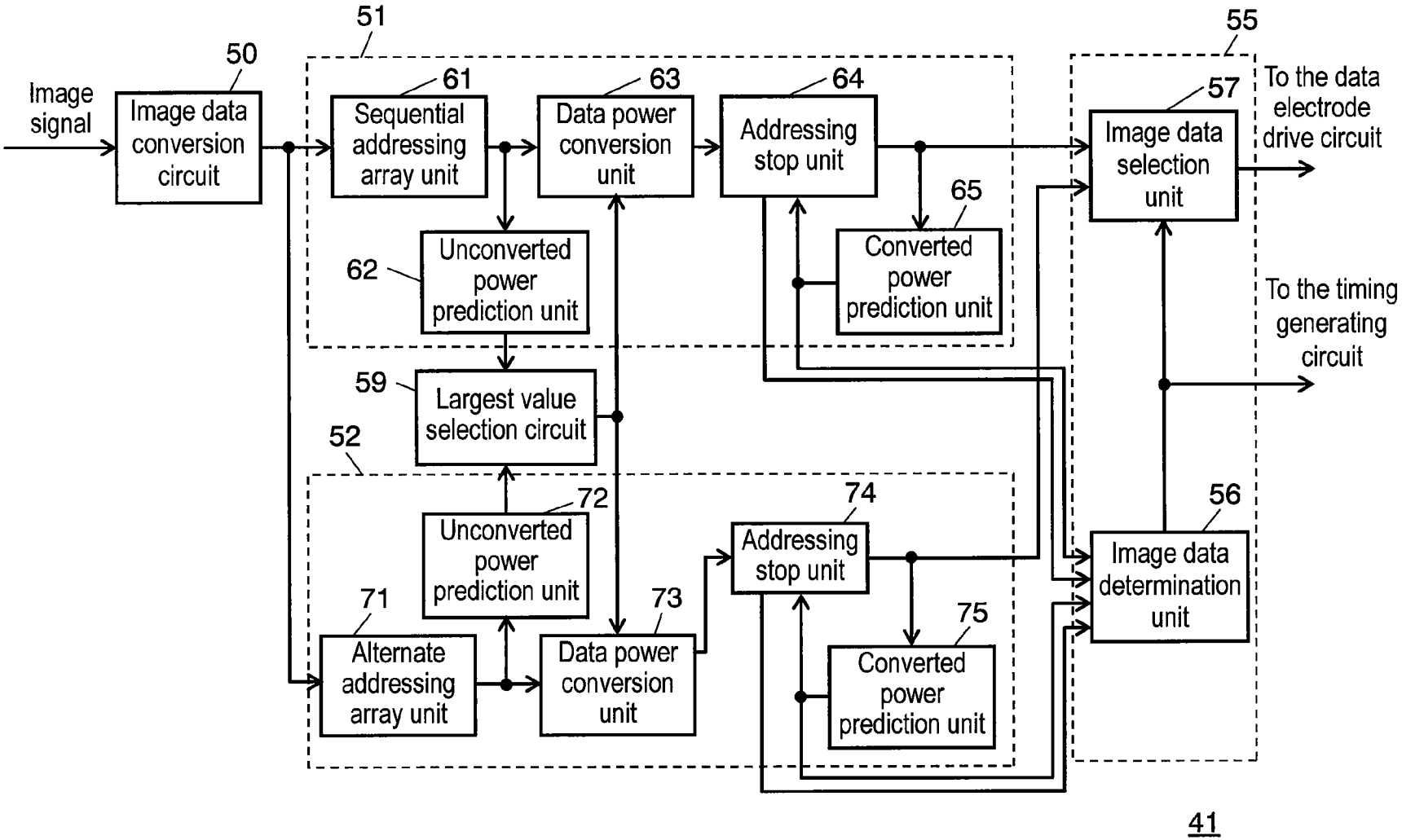
FIG. 9 is a circuit block diagram showing details of an image signal processing circuit of the plasma display device according to the embodiment of the present invention.

The following is a detailed description of image signal processing circuit 41. FIG. 9 is a circuit block diagram showing details of image signal processing circuit 41 of plasma display device 100.

Image signal processing circuit 41 includes image data conversion circuit 50, sequential addressing processing circuit 51, alternate addressing processing circuit 52, image data selection circuit 55, and largest value selection circuit 59.

Image data conversion circuit 50 converts a received image signal into image data indicating emission or non-emission of light in each subfield.

Sequential addressing processing circuit 51 arranges the image data received from image data conversion circuit 50 in the order corresponding to the sequential address operation, and then converts the image data so that the electric power consumption of data electrode drive circuit 42 is not more than the predetermined power threshold value when the sequential address operation is performed.

Alternate addressing processing circuit 52 arranges the image data received from image data conversion circuit 50 in the order corresponding to the alternate address operation, and then converts the image data so that the electric power consumption of data electrode drive circuit 42 is not more than the predetermined power threshold value when the alternate address operation is performed.

Image data selection circuit 55 includes image data determination unit 56 and image data selection unit 57. Image data determination unit 56 determines which operation to be selected between a sequential address operation and an alternate address operation by comparing the image display quality or the like of the image data of sequential addressing processing circuit 51 and alternate addressing processing circuit 52. Image data selection unit 57 selects between the output of sequential addressing processing circuit 51 and the output of alternate addressing processing circuit 52 based on the determination result of image data determination unit 56.

Largest value selection circuit 59 receives the electric power consumption required for the image data arranged in the order corresponding to the sequential address operation and the electric power consumption required for the image data arranged in the order corresponding to the alternate address operation, and outputs the value of the larger one of the two, which will be described in detail later.

Sequential addressing processing circuit 51 will be described in detail as follows. Sequential addressing processing circuit 51 includes sequential addressing array unit 61, first unconverted power prediction unit 62 (hereinafter, "unconverted power prediction unit 62"), first data power conversion unit 63 (hereinafter, "data power conversion unit 63"), first addressing stop unit 64 (hereinafter, "addressing stop unit 64"), and first converted power prediction unit 65 (hereinafter, "converted power prediction unit 65").

Sequential addressing array unit 61 arranges the image signal received from image data conversion circuit 50 in the order corresponding to the sequential address operation. In the embodiment, in order to make sequential addressing processing circuit 51 output in phase with the output of alternate addressing processing circuit 52, sequential addressing array unit 61 takes image data for one field into the memory, and outputs the corresponding image data in the order of scan electrodes SC1, SC2, SC3, . . . SCn.

Unconverted power prediction unit 62 predicts the estimates of the electric power consumptions of the data drivers of data electrode drive circuit 42 individually based on the image data from sequential addressing array unit 61. Unconverted power prediction unit 62 then outputs the largest value of the estimates of these electric power consumptions to largest value selection circuit 59. As described above, the electric power of data electrode drive circuit 42 increases with increasing number of times of changes in voltage applied to data electrode Dj, and further increasing with the anti-phase change in the voltage applied to adjacent data electrodes Dj+1 and Dj−1. In view of this relation, the electric power required for driving data electrodes D1 to Dm can be estimated by calculating the sum of exclusive ORs of each bit of the four pixels vertically and horizontally adjacent to the pixel of interest displayed based on each bit of the image data corresponding to each subfield. Unconverted power prediction unit 62 in the embodiment calculates the sum of exclusive ORs of the image data corresponding to data drivers IC1 to IC16, predicts the estimates of the electric powers of data drivers IC1 to IC16, and outputs the largest value. Thus, unconverted power prediction unit 62 predicts the electric power consumption of data electrode drive circuit 42 based on the image data from sequential addressing array unit 61.

Similar to unconverted power prediction unit 62, converted power prediction unit 65 predicts the estimates of the electric power consumptions of the data drivers of data electrode drive circuit 42 individually based on the received image data, that is, based on the image data from addressing stop unit 64. Converted power prediction unit 65 then outputs the largest value of the estimates of the electric power consumptions. Thus, converted power prediction unit 65 predicts the electric power consumption of data electrode drive circuit 42 based on the image data from addressing stop unit 64. Converted power prediction unit 65 further predicts the estimates of the electric power consumptions of the data drivers of data electrode drive circuit 42 individually based on the received image data. The total of the estimates is outputted as the total electric power consumption of data electrode drive circuit 42.

Data power conversion unit 63 converts the image data corresponding to specific subfields received from sequential addressing array unit 61 into the image data requiring low electric power consumption of data electrode drive circuit 42. The conversion of the image data is performed based on the output of largest value selection circuit 59 as follows.

Data power conversion unit 63 compares the gradation value of the image data based on which an address operation is performed for the data electrodes at a certain timing and the gradation value of the image data based on which an address operation is performed at the next timing. When the image data based on which an address operation is performed at a certain timing (hereinafter abbreviated as "upper data") has a smaller gradation value than the image data based on which an address operation is performed at the next timing (hereinafter abbreviated as "lower data"), data power conversion unit 63 outputs the upper data intact. When the upper data has a larger gradation value than the lower data, on the other hand, the upper data is outputted after being converted so that the upper and lower data have the same emitting state in specific subfields in ascending order of luminance weight. The expression "the upper and lower data have the same emitting state in specific subfields" means that the upper data and the lower data are equal to each other in the specific subfields.

The number of the specific subfields having the same emitting state between the upper and lower data is determined based on the output of largest value selection circuit 59. The number of the specific subfields having the same emitting state increases with increasing output and decreases with decreasing output. These specific subfields have small luminance weights.

The conversion causes errors in gradation values, but the difference in the upper data between before and after conversion is scattered as an error signal to lower data which is lower than the above-described lower data. The scattering of errors can keep the average gradation value, thereby providing nearly the same brightness as in the original image.

FIGS. 10A, 10B, 10C, 10D, and 10E are diagrams for explaining the operation of data power conversion unit 63 of plasma display device 100. These diagrams show the image data to be outputted when the image signal arranged in a checkerboard pattern of FIG. 6A is received. First, the gradation value "3" of the image signal corresponding to the discharge cell in the line of the scan electrode SCi−2 and in the column of the data electrode Dj−2 is compared with the gradation value "12" of the image signal corresponding to the discharge cell in the line of the scan electrodes SCi−1, which is the lower data. In this case, since the upper data is smaller than the lower data, the gradation value "3" of the upper data, that is, the image data "0011" is outputted intact.

In addition, the gradation value "12" of the image signal corresponding to the discharge cell in the line of scan electrode SCi−2 and in the column of data electrode Dj−1 is compared with the gradation value "3" of the image signal corresponding to the discharge cell in the line of scan electrode SCi−1, which is the lower data. In this case, since the upper data is larger than the lower data, the image signal is converted so that the specific subfields having small luminance weights have the same emitting state between the upper and lower data.

For example, assume that the number of the specific subfields having the same emitting state between the upper and lower data is "2". Then, the aforementioned gradation value "12" is converted into a gradation value "15" so as to make the image data in the first and second SFs equal to the image data of the lower data, thereby outputting image data "1111". In order to correct the error "−3" between the original gradation value "12" and the replaced gradation value "15", the image signal corresponding to the discharge cell in the line of scan electrode SCi is added with "−3". As a result, the discharge cell in the line of scan electrodes SCi and the column of data electrodes Dj−1 has a gradation value "9" (="12"+"−3").

Similarly, the gradation value "12" of the image signal corresponding to the discharge cell in the line of scan electrode SCi−1 and in the column of data electrode Dj−2 is compared with the gradation value "3" of the lower data and is converted into a gradation value "15". The discharge cell in the line of scan electrode SCi+1 is added with the error to obtain a gradation value "9".

The gradation value "3" of the image signal corresponding to the discharge cell in the line of scan electrode SCi−1 and in the column of data electrode Dj−1 is outputted intact.

The gradation value "3" of the image signal corresponding to the discharge cell in the line of scan electrode SCi and in the column of data electrode Dj−2 is outputted intact.

The gradation value of the image signal corresponding to the discharge cell in the line of scan electrode SCi and in the column of data electrode Dj−1 is changed to "9" as the result of the addition of the error as described above. Therefore, the gradation value "9" is compared with the gradation value "3" of the lower data and is converted to a gradation value "11" to make the image data in the first and second SFs equal to the image data of the lower data. In order to correct the error "−2" between the original gradation value "9" and the replaced gradation value "11", the image signal corresponding to the discharge cell in the row of scan electrodes SCi+2 is added with "−2" so as to make the gradation value "10" (="12"+"−2").

Data power conversion unit 63 performs the signal processing so as to convert the gradation values of FIG. 6A to the gradation values of FIG. 10A. FIG. 10B shows the LSB of the image data thus converted, that is, the presence or absence of an address pulse in the first SF. Similarly, FIGS. 10C, 10D, and 10E show the presence or absence of an address pulse in the second, third, and fourth SFs, respectively.

In the address periods of the first and second SFs, address pulses are applied to data electrodes, while each of the all scan electrodes is scanned. Therefore, the voltage applied to the data electrodes causes no change. As a result, data electrode drive circuit 42 has a smaller charge-discharge current and hence a smaller electric power consumption. Furthermore, since the error caused by the conversion of image data is scattered to the image data corresponding to another discharge cell, the average value of the gradation value of the image data to be displayed is maintained. This suppresses a decrease in image display quality caused by the conversion of image data.

Thus, data power conversion unit 63 can suppress the electric power consumption of data electrode drive circuit 42 while suppressing a decrease in image display quality. However, since there is a limit to the reduction of electric power consumption, there is no guarantee that the electric power consumption of data electrode drive circuit 42 is not more than the predetermined power threshold value. The predetermined power threshold value is set to, for example, 90% of the allowable power loss of each data driver IC used in data electrode drive circuit 42. In the case of using data drivers IC having different allowable power losses from each other, 90% of the smallest allowable power loss is referred to as the predetermined power threshold value.

Addressing stop unit 64 of FIG. 9 is provided to control the electric power consumption of data electrode drive circuit 42 to be not more than the predetermined power threshold value by stopping the address operation in specific subfields based on the output of converted power prediction unit 65. The specific subfields in which the address operation is stopped by addressing stop unit 64 and the specific subfields which are considered to have the same emitting state by data power conversion unit 63 are determined separately and not necessarily the same. More specifically, when the electric power predicted by converted power prediction unit 65 exceeds the predetermined power threshold value, addressing stop unit 64 converts all the corresponding image data to "0" in the specific subfields in ascending order of luminance weight. Thus, addressing stop unit 64 converts the image data received from data power conversion unit 63 so that the address operation in the specific subfields is stopped until the electric power predicted by converted power prediction unit 65 becomes not more than the predetermined power threshold value. Addressing stop unit 64 thus controls the electric power consumption of data electrode drive circuit 42 to be not more than the predetermined power threshold value. This conversion process, however, also decreases image display quality.

As described above, sequential addressing processing circuit 51 converts the image data received from image data conversion circuit 50 into the image data which allows the electric power consumption of data electrode drive circuit 42 to be not more than the power threshold value. This conversion process, however, may greatly decrease image display quality.

Alternate addressing processing circuit 52 of FIG. 9 will be described in detail as follows. Alternate addressing processing circuit 52 includes alternate addressing array unit 71, second unconverted power prediction unit 72 (hereinafter, "unconverted power prediction unit 72"), second data power conversion unit 73 (hereinafter, "data power conversion unit 73"), second addressing stop unit 74 (hereinafter, "addressing stop unit 74"), and second converted power prediction unit 75 (hereinafter, "converted power prediction unit 75").

Alternate addressing array unit 71 converts the image data received from image data conversion circuit 50 into image data arranged in the order corresponding to an alternate address operation. In the embodiment, alternate addressing array unit 71 takes image data for one field into the memory, and outputs the corresponding image data in the order of scan electrodes SC1, SC3, SC5, . . . SCn−1, SC2, SC4, SC6, . . . SCn.

Unconverted power prediction unit 72, data power conversion unit 73, addressing stop unit 74, and converted power prediction unit 75 have the same circuit configurations as unconverted power prediction unit 62, data power conversion unit 63, addressing stop unit 64, and converted power prediction unit 65, respectively, of sequential addressing processing circuit 51 described above. Since alternate addressing array unit 71 outputs the corresponding image data in the order of scan electrodes SC1, SC3, SC5, . . . SCn−1, SC2, SC4, SC6, . . . SCn, unconverted power prediction unit 72, data power conversion unit 73, addressing stop unit 74, and converted power prediction unit 75 process the image data in this order.

Unconverted power prediction unit 72 and converted power prediction unit 75 predict the electric power required for driving data electrodes D1 to Dm by calculating the sum of exclusive ORs of each bit of the pixel two pixels above the pixel of interest, the pixel two pixels below the pixel of interest, and the two pixels horizontally adjacent to the pixel of interest displayed based on each bit of the image data corresponding to each subfield. Thus, unconverted power prediction unit 72 predicts the electric power consumption of data electrode drive circuit 42 based on the image signal received from alternate addressing array unit 71.

When the upper data has a smaller gradation value than the lower data, data power conversion unit 73 outputs the upper data intact in the same manner as data power conversion unit 63. When the upper data has a larger gradation value than the lower data, on the other hand, the upper data is outputted after being converted so that the upper and lower data have the same emitting state in the specific subfields having small luminance weights. Note that the lower data corresponds to the pixel two pixels below the pixel of interest. Thus, data power conversion unit 73 converts the image signal received from alternate addressing array unit 71 corresponding to specific subfields into image data which allows data electrode drive circuit 42 to have low electric power consumption.

Second addressing stop unit 74 converts the output of data power conversion unit 73 so that the address operation in the specific subfields is stopped until the electric power consumption of data electrode drive circuit 42 becomes not more than the predetermined power threshold value.

Converted power prediction unit 75 predicts the electric power consumption of data electrode drive circuit 42 based on the image data received from addressing stop unit 74.

The number of specific subfields having the same emitting state between the upper and lower data is determined based on the output of largest value selection circuit 59 in the same manner as in data power conversion unit 63. As a result, the number of specific subfields having the same emitting state between the upper and lower data is always the same between data power conversion units 73 and 63.

Thus, similar to sequential addressing processing circuit 51, alternate addressing processing circuit 52 converts the image data received from image data conversion circuit 50 into image data which allows the electric power consumption of data electrode drive circuit 42 to be not more than the power threshold value. This conversion process, however, may greatly decrease image display quality.

FIG. 11 shows the operation of image data determination unit 56 of plasma display device 100 of FIG. 9. Image data determination unit 56 compares the number of the specific subfields in which the address operation is stopped (all image data is converted to "0") by addressing stop unit 64 of sequential addressing processing circuit 51 and the number of the specific subfields in which the address operation is stopped (all image data is converted to "0") by addressing stop unit 74 of alternate addressing processing circuit 52. The smaller the number of the specific subfields in which the address operation is stopped, the better image display quality. Therefore, image data determination unit 56 determines, as the output to be selected, the output having the smaller number of specific subfields in which the address operation is stopped of the two outputs: one from sequential addressing processing circuit 51 and the other from alternate addressing processing circuit 52.

On the other hand, when the number of the specific subfields in which the address operation is stopped is the same between sequential addressing processing circuit 51 and alternate addressing processing circuit 52, the image display quality is considered to be nearly the same. Therefore, it is possible to select either of the output of sequential addressing processing circuit 51 or the output of alternate addressing processing circuit 52. In the embodiment, however, when the number of the specific subfields in which the address operation is stopped is the same, image data determination unit 56 compares between the total electric power consumption predicted by converted power prediction unit 65 of sequential addressing processing circuit 51 and the total electric power consumption predicted by converted power prediction unit 75 of alternate addressing processing circuit 52. Then, image data determination unit 56 determines based on the comparison result, as the output to be selected, the output having the lower total electric power consumption of the two outputs: one from sequential addressing processing circuit 51 and the other from alternate addressing processing circuit 52. This makes it possible to select the image data having the lower total electric power consumption of data electrode drive circuit 42 in the case where image display quality is nearly the same.

Image data selection unit 57 selects either the output of sequential addressing processing circuit 51 or the output of alternate addressing processing circuit 52 based on the determination result of image data determination unit 56.

It is necessary to change the timing of the scan pulse depending on which has been selected between the output of sequential addressing processing circuit 51 and the output of alternate addressing processing circuit 52. Therefore, timing generating circuit 45 of FIG. 5 generates various timing signals for generating appropriate drive voltage waveforms based on the determination result of image data determination unit 56.

Thus, image signal processing circuit 41 converts the image data in such a manner that the image display quality is not largely decreased and that the electric power consumption of data electrode drive circuit 42 is not more than the predetermined threshold value.

In addition, as described above, the embodiment includes largest value selection circuit 59. Largest value selection circuit 59 selects the larger of the two outputs: one from unconverted power prediction unit 62 and the other from unconverted power prediction unit 72, and outputs it to data power conversion units 63 and 73. As a result, data power conversion units 63 and 73 convert the image data based on the output of largest value selection circuit 59 while keeping the number of the specific subfields having the same emitting state between the upper and lower data always the same. As a result, it is considered that the image data from data power conversion unit 63 and the image data from data power conversion unit 73 have nearly the same image display quality.

Therefore, when the number of the specific subfields in which the address operation is stopped by addressing stop unit 64, and the number of the specific subfields in which the address operation is stopped by addressing stop unit 74 are equal to each other, the switching of image data by image data selection circuit 55 hardly causes flickering or other similar problems.

The specific values shown in the embodiment are one example, and can be changed depending on the properties of the panel or the specification, or the like of the plasma display device.

Industrial Applicability

The plasma display device of the present invention is useful as a display device such as a TV because it produces no flickering or other similar problems, causes no great decrease in image display quality, and controls the electric power consumption to be not more than a predetermined threshold value.

The invention claimed is:

1. A plasma display device comprising:

a sequential addressing processing circuit including:

a sequential addressing array unit for arranging a received image data into sequential image data corresponding to a sequential address operation for sequentially driving scan electrodes in the plasma display device, a sequential data power conversion unit for converting gradation values in the sequential image data to reduce power consumption when sequentially driving the scan electrodes, and a sequential power prediction unit for predicting the power consumption when sequentially driving the scan electrodes;

an alternate addressing processing circuit including:

an alternate addressing array unit for arranging the received image data into alternate image data corresponding to an alternate address operation for alternately driving the scan electrodes in the plasma display device, an alternate data power conversion unit for converting gradation values in the alternate image data to reduce power consumption when alternately driving the scan electrodes, and an alternate power prediction unit for predicting the power consumption when alternately driving the scan electrodes; and an image data selection circuit for selecting between an output of the sequential addressing processing circuit and an output of the alternate addressing processing circuit based on the predicted power consumption when sequentially driving the scan electrodes, and the predicted power consumption when alternately driving the scan electrodes.

2. The plasma display device of claim 1, including a plasma display panel including a plurality of discharge cells, each of the discharge cell having a data electrode and a display electrode pair consisting of a scan electrode and a sustain electrode;

a scan electrode drive circuit, a sustain electrode drive circuit, and a data electrode drive circuit for driving the scan electrode, the sustain electrode, and the data electrode, respectively, in one field composed of a plurality of subfields each having an address period where a sequential address operation or an alternate address operation is performed, and a sustain period where the discharge cells that have performed the address operation emit light, the sequential address operation being performed by applying scan pulses sequentially to the scan electrodes and applying address pulses to the data electrodes, and the alternate address operation being performed by applying scan pulses alternately to the scan electrodes and applying address pulses to the data electrodes; and an image signal processing circuit for converting the received image signal into the image data to be supplied to the data electrode drive circuit.

3. The plasma display device of claim 2, wherein the sequential addressing processing circuit includes, a sequential unconverted power prediction unit for predicting electric power consumption of the data electrode drive circuit based on an image data received from the sequential addressing array unit;

a sequential addressing stop unit for converting image data received from the sequential data power conversion unit so that an address operation in the specific subfields is stopped until the electric power consumption of the data electrode drive circuit becomes not more than a predetermined power threshold value; and a sequential converted power prediction unit for predicting electric power consumption of the data electrode drive circuit based on image data received from the sequential addressing stop unit.

4. The plasma display device of claim 2, wherein the alternate addressing processing circuit includes, a alternate unconverted power prediction unit for predicting electric power consumption of the data electrode drive circuit based on an image data received from the alternate addressing array unit;

a alternate addressing stop unit for converting image data received from the alternate data power conversion unit so that an address operation in the specific subfields is stopped until the electric power consumption of the data electrode drive circuit becomes not more than a predetermined power threshold value; and a alternate converted power prediction unit for predicting electric power consumption of the data electrode drive circuit based on image data received from the alternate addressing stop unit.

5. The plasma display device of claim 2, wherein the image signal processing circuit equalizes the number of the specific subfields for which the sequential data power conversion unit converts the image data converted from the received image signal into image data which allows the data electrode drive circuit to have low electric power consumption, and the number of the specific subfields for which the alternate data power conversion unit converts the image data converted from the received image signal into image data which allows the data electrode d rive circuit to have low electric power consumption.

6. The plasma display device of claim 2, including, a sequential unconverted power prediction unit for predicting electric power consumption of the data electrode drive circuit based on an image data received from the sequential addressing array unit; and a alternate unconverted power prediction unit for predicting electric power consumption of the data electrode drive circuit based on an image data received from the alternate addressing array unit, wherein the number of the specific subfields for which the sequential data power conversion unit and the alternate data power conversion unit convert the image data converted from the received image signal into the image data which allows the data electrode drive circuit to have low electric power consumption is determined based on the larger electric power between the electric power consumption predicted by the sequential unconverted power prediction unit and the electric power consumption predicted by the alternate unconverted power prediction unit.

* * * * *